US005226629A

United States Patent [19]

Millman et al.

[11] Patent Number: 5,226,629

[45] Date of Patent: Jul. 13, 1993

[54] REMOTE CONTROLLED FAUCET

[76] Inventors: Paul Millman, 201 W. 70th St., New York, N.Y. 10023; Mark Schwartz, 4089 Aberdeen Ct., Orchard Lake, Mich. 48323

[21] Appl. No.: 885,460

[22] Filed: May 19, 1992

[51] Int. Cl.[5] ..... F16K 31/04; E03C 1/05

[52] U.S. Cl. ..... 251/129.04; 251/295; 137/606; 4/623; 222/179; 222/504

[58] Field of Search ..... 251/129.04, 295; 4/623; 222/179, 52, 504; 137/606

[56] References Cited

U.S. PATENT DOCUMENTS

| | | | |
|---|---|---|---|
| 2,270,239 | 1/1942 | Cushman . | |
| 3,726,477 | 4/1973 | Shapiro . | |
| 4,052,035 | 10/1977 | Kenny et al. . | |
| 4,275,866 | 6/1981 | Jamar . | |
| 4,682,628 | 7/1987 | Hill | 4/623 X |
| 4,688,277 | 8/1987 | Kakinoki et al. | 4/623 |
| 4,790,514 | 12/1988 | Marks . | |
| 4,838,310 | 6/1989 | Scott . | |
| 4,845,416 | 7/1989 | Scholl et al. . | |
| 5,033,715 | 7/1991 | Chiang et al. | 4/623 |
| 5,092,560 | 3/1992 | Chen | 251/129.04 X |
| 5,125,623 | 6/1992 | Kiedinger | 222/179 X |

FOREIGN PATENT DOCUMENTS

| | | | |
|---|---|---|---|
| 0028076 | 2/1983 | Japan | 251/129.04 |

*Primary Examiner*—Arnold Rosenthal
*Attorney, Agent, or Firm*—Natter & Natter

[57] ABSTRACT

A remote controlled faucet has a valve assembly attachable to a nozzle of the faucet. The valve assembly includes a battery-powered motor-driven valve member and a radio receiving unit for actuating the motor in response to signals received from a remote sending unit. The sending unit is operated by the action of the user's foot for providing "hands-free" control of the faucet. In an alternate embodiment, the valve assembly is used to remotely control an independent hot and cold water faucet supply line to regulate water temperature and pressure.

17 Claims, 3 Drawing Sheets

FIG. 7
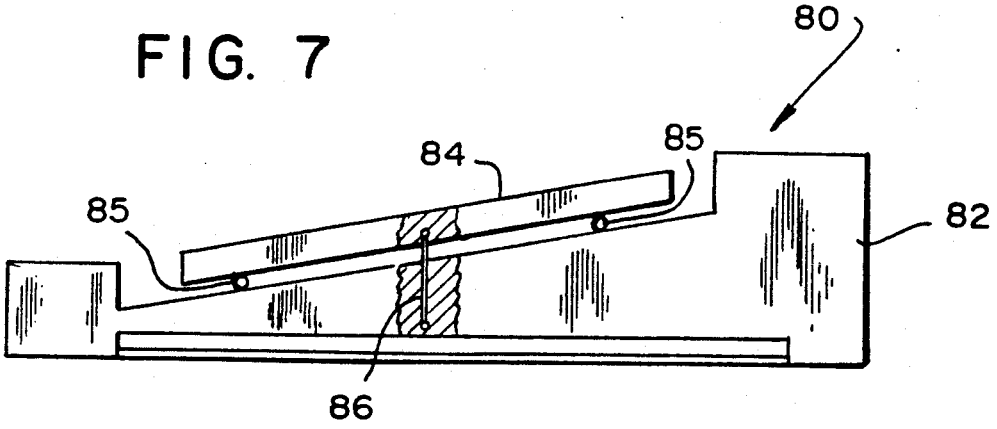
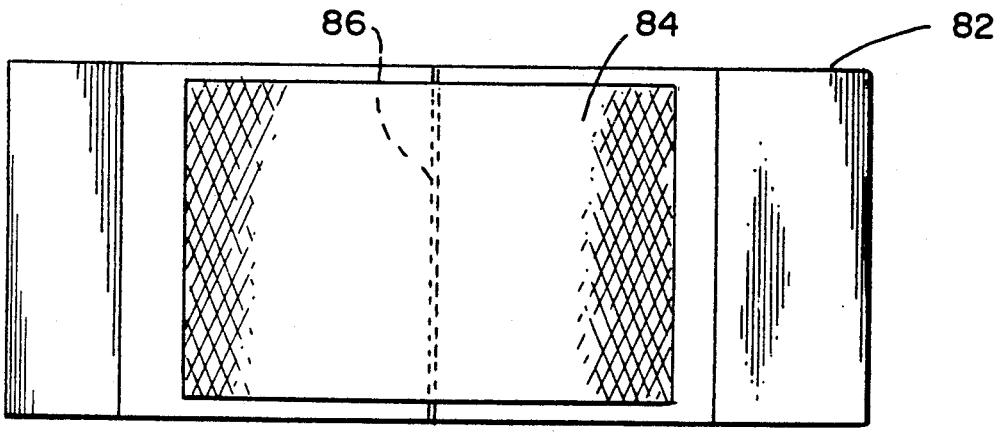
FIG. 8
FIG. 9
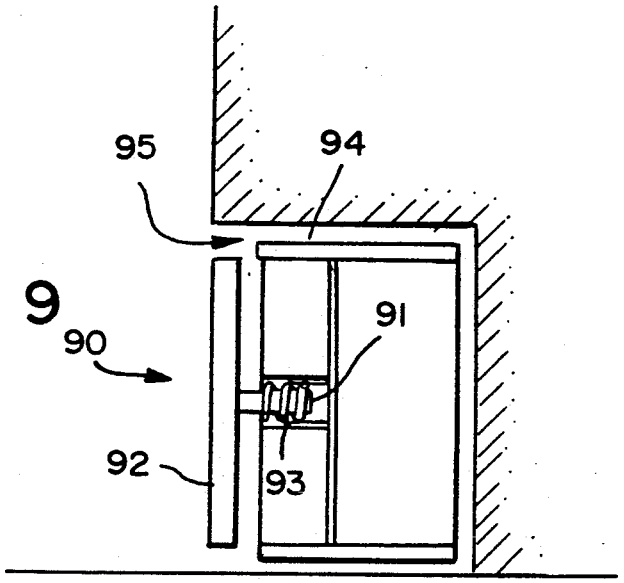

REMOTE CONTROLLED FAUCET

TECHNICAL FIELD

This invention relates generally to fluid flow through pipes and especially to the regulation of water flow through a faucet.

In particular, the invention concerns a faucet having a valve remotely controlled by space-transmitted electromagnetic energy.

BACKGROUND ART

As a result of increased environmental awareness, water conservation has become an important issue especially in the Western part of United States, densely populated areas elsewhere within the United States and in other countries or regions that have arid climates.

With regard to domestic water consumption in this country, the ultimate use is generally for sanitary, culinary, drinking, washing or bathing purposes. It has been found that careless or willful waste occurs during the performance of certain of these tasks such as washing dishes, preparing food, brushing teeth, etc. wherein the user permits the water to flow continuously from the faucet rather than to temporarily shut-off the flow, when water is not needed, during these procedures. The primary reason for not interrupting the water flow is generally because the user's hands are occupied or because of the effort required to again achieve the same water temperature and/or pressure.

By way of example, water consumption during the process of washing and rinsing a typical load of dishes for four place settings, consumes 7.5 gallons of water or approximately one cubic foot of water. During the wash/rinse period, the water is idling for about fifty (50%) percent of the time, thus wasting 0.5 cubic feet.

Aside from the environmental issues, another motivation for reducing consumption is economic in nature in that there is a tendency for the rates charged for metered water to generally increase rather than decrease. Furthermore, the conservation of hot water minimizes the fuel needed to heat the water and thus achieves additional cost savings.

An apparatus to control a water faucet valve without requiring hands-on operation is shown in U.S. Pat. No. 2,270,239. A shortcoming of that device is that the moveable components of the mechanical linkage are subjected to friction and wear resulting in slack and inefficiency. A further problem with that device is that the installation requires a plumber or other skilled workman and it is not particularly adapted as a retro-fit assembly.

Another remote control faucet valve device, as shown in U.S. Pat. No. 4,052,035, utilizes a flexible conduit for communicating between a foot control member and a valve member. A disadvantage of that arrangement is that the conduit is draped over the sink and the kitchen cabinet when in use and thus presents a physical impediment or hinderance which interferes with access to the sink and underlying cabinet. The conduit can also further become entangled with kitchen appliances. Additionally, the hydraulic system has a restricted range of control functions.

With regard to wireless control systems utilizing a radio link, these devices have been applied to the operation of motorized toy vehicles and model airplanes. They have also been applied to remote keyless entry systems for locking or unlocking the doors and trunk lid of automobiles. The utilization of radio controls for home automation has been rather limited with the most common usage being for electronic garage door openers.

Fluid handling apparatus employing radio signal control has been applied to irrigation systems as discussed in U.S. Pat. Nos. 3,726,477 and 4,838,310. The systems of the aforementioned patents, however, are not adapted for domestic use and do not include an electronic valve structure or a tactile foot-operated sending unit as in this invention.

BRIEF DESCRIPTION OF THE INVENTION

The nature of this invention involves the regulation of water flow through a faucet by a valve wherein the valve functions are controlled from a distant location using electromagnetic radiation.

The remote controlled faucet is intended for typical application with kitchen sinks or bathroom wash basins and provides a "hands-free" alternative to manual operation of faucet levers or handles for flow regulation.

Briefly, the invention encompasses a faucet valve assembly that includes a valve member, a motor for operating the valve member and a power source for energizing the motor. In addition, the valve assembly houses a radio receiving unit that generates command signals to actuate the motor.

A sending unit is designed to be in radio communication with the receiving unit and to transmit valve control instructions. The valve assembly is adapted for selective attachment to a discharge opening of the faucet to provide for "on/off" operation and pressure adjustment. In an alternate embodiment, separate valve assemblies are fitted to each of the hot and cold water faucet supply lines to provide additional control capabilities. This last-mentioned arrangement permits the user to adjust water temperature as well as "on/off" and pressure functions.

A feature of this invention is that the sending unit is adapted to respond to the position and/or pressure of the user's foot. In one embodiment, a rollerball is manipulated by the user's foot for increasing or reducing water flow. Another version of the foot-operated sending unit is sensitive to forward or backward sliding pressure of the user's foot for alternatively increasing or reducing water flow. A further variant of the foot-operated sending unit employs a kickpad wherein successive depressions toggles flow either "on" or "off".

An advantage of this invention is that the wireless communication between the sending unit and the valve assembly is not readily subject to mechanical breakdown nor does it require obtrusive hardware for implementation.

In view of the foregoing, it should be apparent that the present invention overcomes many of the shortcomings and deficiencies of the prior art and provides an improved remote controlled faucet.

Having thus summarized the invention, it will be seen that it is an object thereof to provide a remote controlled faucet of the general character described herein which is not subject to the aforementioned disadvantages.

Another object of this invention is to provide a remote controlled faucet for regulating water flow utilizing radio communication.

A further object of this invention is to provide a remote controlled faucet having a motorized valve assembly actuated by radio signals from a distant sending unit.

Still another object of this invention is to provide a remote controlled faucet wherein the sending unit is operated by the action of the user's foot.

Another object of this invention is to provide a remote controlled faucet which is convenient to use and readily adapted for retro-fit installation.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention:

FIG. 7 is an elevational view in section illustrating an alternate foot-operated sending unit utilizing a pivotal pressure pad;

FIG. 8 is a plan view showing the foot-operated sending unit of FIG. 7; and

FIG. 9 shows an elevational view, in section, of a further embodiment of a foot-operated sending unit utilizing kickpad and adapted for a space-saving installation within the cove of a kitchen cabinet or bathroom vanity.

DETAILED DESCRIPTION OF THE INVENTION

Figure 1:
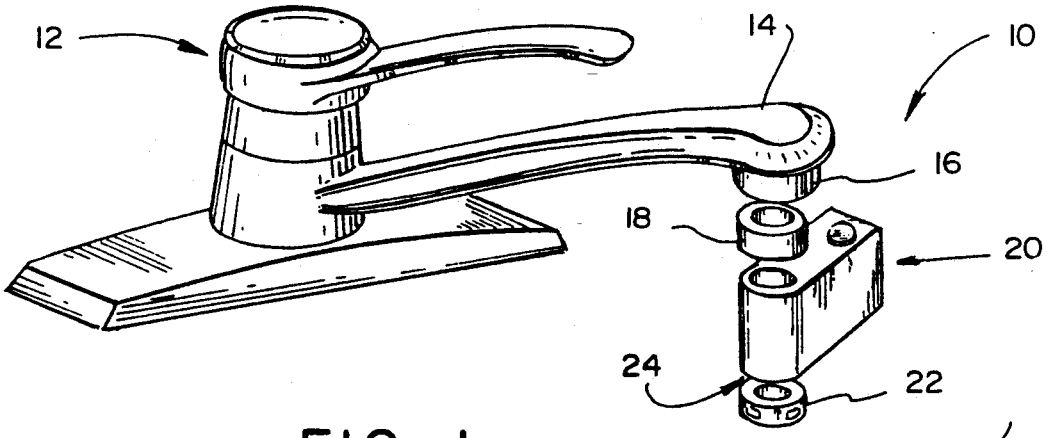
FIG. 1 is a perspective view illustrating in exploded fashion, a remote controlled faucet of this invention having a valve assembly incorporating a radio receiving unit.

Referring now in detail to the drawings, the reference numeral 10 denotes generally a remote controlled faucet in accordance with this invention.

The remote controlled faucet 10 is intended for use as a retro-fit modification to an existing faucet however, the concept of this device can be adapted to original equipment manufacture as will be described with regard to an alternative embodiment.

Referring now to FIG. 1, there is shown a typical single-lever faucet 12 including a spout 14 having a nozzle 16. A coupler member 18 is adapted for threadable connection at one end to the nozzle 16 and at an opposite end to a valve assembly 20 of this invention. For the purpose of illustration, an aerator member 22 is shown as being threadably attachable to the valve assembly 20 at a discharge opening 24 thereof.

It should be noted that the valve assembly 20 is preferably mounted in front of or alongside the spout 14 since the sloped orientation of the spout 14 does not generally provide sufficient clearance for underside mounting. The location of the valve assembly 10 however, will not substantially obstruct the user's view within the sink or wash basin during operation of the faucet 12.

By way of example, the valve assembly 20 is contained within a generally rectangular shaped housing approximately 3 to 5 inches in length, 3 to 4 inches in height and 1 to 2 inches in width.

Figure 3:
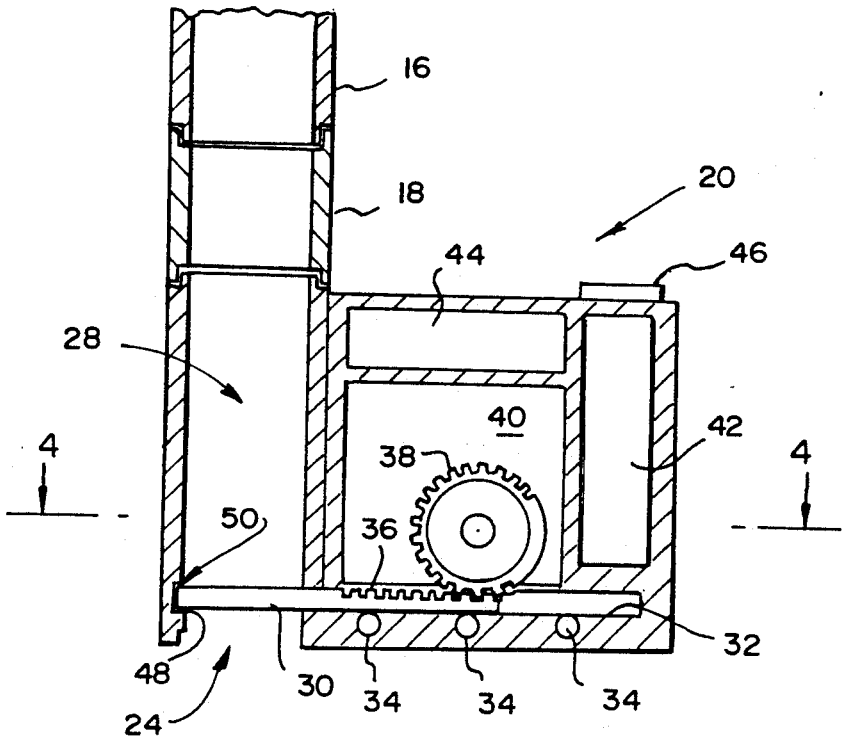
FIG. 3 is a sectional view, to an enlarged scale, of the valve assembly coupled to a discharge opening of the faucet showing a valve member, a motor for displacing the valve member, a power source for energizing the motor, and a radio receiving unit.
Figure 4:
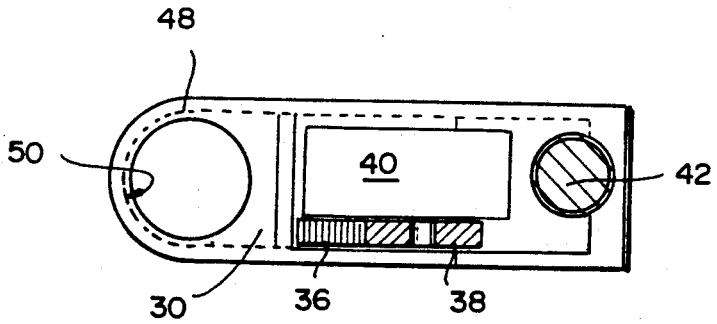
FIG. 4 is a sectional view taken substantially along line 4—4 of FIG. 3 showing the valve member seated in a closure position.

As best shown in FIGS. 3 and 4, a longitudinal passageway 28 provides a continuous flow path from the nozzle 16 through the coupling member 18, the valve assembly 20 and exiting at the discharge opening 24. Flow control is achieved by utilizing a gate valve member 30 which is translatable into the passageway 28 above the discharge opening 24 to provide a partial or full closure. Thus the discharge flow can be selectively reduced and/or temporarily interrupted.

The gate valve member 30 is slidably mounted upon a rectilinear track 32 that includes a plurality of underlying roller bearings 34. A portion of an upper surface of the valve member 30 defines a gear rack 36. A pinion gear 38 driven by a motor 40, is preferably designed for operation under low-voltage DC and is powered by battery pack 42 such as rechargeable nickel-cadmium batteries. The battery pack 42 further energizes a radio receiving unit 44 within the valve assembly 20. The receiving unit 44 can be of a type commercially available, e.g. model # R 102JE (27 MHz) manufactured by Futaba Corporation of America that is coupled to an electronic speed controller (model # MC 112B). A manually operated override switch 46 optionally locks the gate valve member 30 in an open position and deactivates the receiving unit 44 when discharge flow is to be controlled exclusively by manual operation of the faucet 12.

Further with regard to the operation of the valve assembly 20, it should be noted that the pinion gear 38 is adapted for meshing engagement with the gear track 36 for displacing the gate valve member 30 into the passageway 28. As illustrated in FIGS. 3 and 4, when the valve member 30 is in a fully seated position and discharge flow is temporarily interrupted. For the purpose of accomplishing a tight seal, an edge 48 of the valve member 30 is adapted to engage within a groove 50 partially circumscribing the passageway 28.

Figure 5:
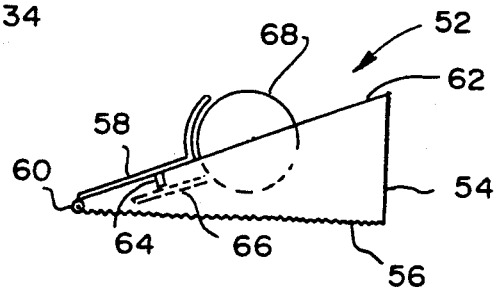
FIG. 5 is an elevational view of a foot-pedal sending unit illustrating a rollerball control member.
Figure 6:
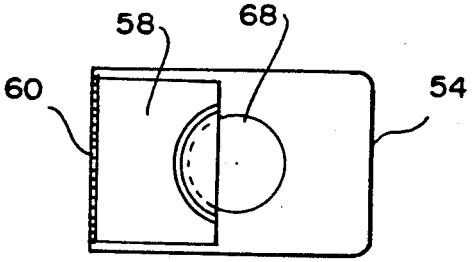
FIG. 6 is a plan view of the foot-pedal sending unit of FIG. 5 showing a foot-pedal switch in partial overlying relationship with regard to the rollerball control member.

Referring now to FIGS. 5 and 6, there is shown a sending unit 52 incorporating a commercially available radio transmitter such as model # 2 NBR (Attack R) manufactured by Futaba Corporation of America. In view of the short operating distance (approximately 5 feet) the sending unit 52 can be operated at a low power level and no external antenna is necessary for the receiving unit 44. The transmitter (not shown) within the sending unit 52 is designed to radiate radio frequency signals, preferably within the frequency band of 27 MHz. Other control frequency channels may be utilized as regulated by the FCC. The control operations of the motor 40 is also known in the art and, for example, controlled pulses can be used for operating the motor 40 for a required time to move the valve member 30 a fixed distance. The receiver can use a one shot or monostable multi-vibrator circuit or "pulse stretcher" to provide a timing circuit. The transmitter can also send multiple control signals for operating different functions or for controlling multiple receivers.

The sending unit 52 is comprised of a wedge-shaped base member 54 for containing an "off-the-shelf" transmitter and is provided with a non-skid lower surface 56. A foot pedal 58 is secured to the base member 54 at a hinged connection 60 and is further resiliently urged upwardly from a sloped surface 62 of the base member 54. When a downward pressure is applied to the foot pedal 58, contact is completed between a set of terminals 64, 66 for closing a circuit to actuate the transmitter. Directional displacement of a rollerball control member 68, which can be accomplished by toe manipulation, is electronically linked (e.g. by an electronic mixing valve) to the transmitter and can be used for emitting multiple control signals or for "fine tuning" or positionally adjusting the valve member 30.

In operation, the user initially adjusts the water temperature and pressure manually while depressing the foot pedal 58 to retract the valve member 30. When discharge flow is temporarily not required, the user again depresses the foot pedal 58 and the valve member 30 is extended into the fully seating position shown in FIG. 4.

An alternative embodiment of a sending unit 80 will be described with reference of FIGS. 7 and 8. A base member 82 houses a radio transmitter (not shown) such as previously discussed.

The sending unit 80 includes a foot-operated pressure pad 84 that is pivoted about a central axis 86. The pressure pad 84 is resiliently urged into an equilibrium position such as shown in FIG. 7 by spring members 85 however, a forward or backward sliding pressure exerted by the user's foot displaces the pad 84 in opposition to the resilient force. The pad 84 will be moved in a downward direction on either side of the pivotal axis 86 depending upon the placement and direction of force. The downward displacement on one side of the axis 86 actuates a circuit within the transmitter to send control signals to the receiver which can, for example, increase water flow. Conversely, pressure exerted on pad 84 on the opposite side of axis 86 will result in transmission of control signals to the receiver for stopping the water flow.

A still further embodiment of a foot-operated sending unit 90 containing a similar radio transmitter is shown in FIG. 9 wherein a substantial vertically oriented kickpad 92 includes a stem 91 yieldably co-acts with a coil spring 93, or similar resilient member mounted within a base member 94. When a horizontally directed force is applied to the kickpad 92, the stem 91 is displaced in opposition to the resilient spring force to actuate the transmitter. Control signals are, for example, transmitted to the receiver for initiating water flow. When the kickpad 92 is again depressed, control signals are transmitted to the receiver for interrupting the water flow. The size and shape of the sending unit 90 is designed for compatible placement within a cove 95 of a kitchen cabinet or bathroom vanity.

Figure 2:
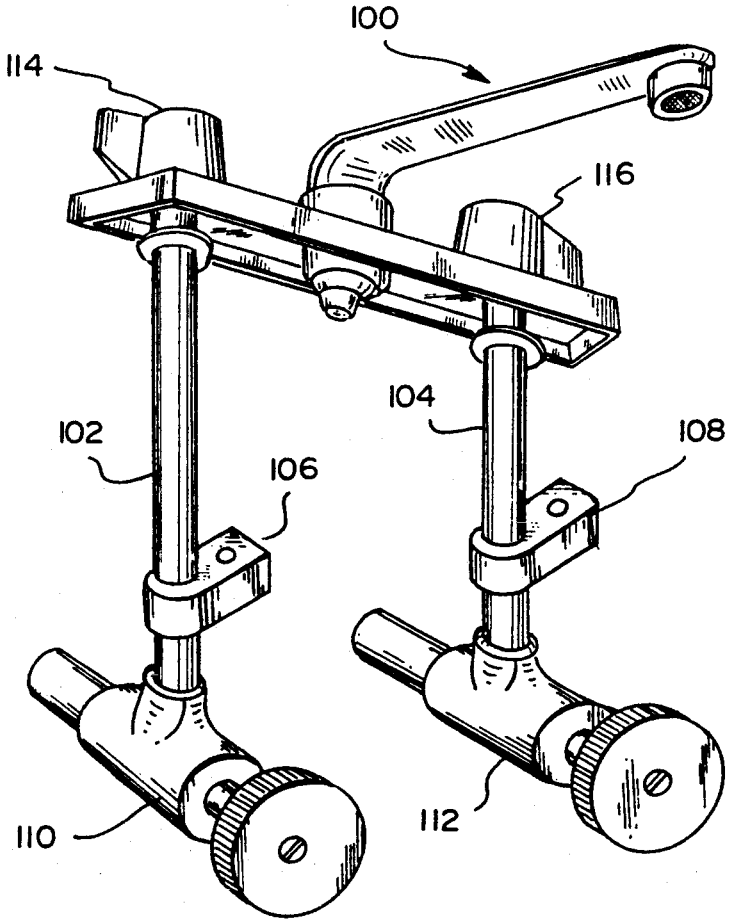
FIG. 2 is a perspective view of an alternative embodiment of the remote controlled faucet of this invention showing two valve assemblies each incorporating receiving units and installed on respective hot and cold water faucet supply lines.

With regard to an alternative application of this invention, reference is made to FIG. 2 wherein there is shown a faucet 100 having an independent hot and cold water faucet supply line 102, 104. A valve assembly 106, 108 is fitted to the respective hot water supply line 102 and cold water supply line 104, preferably between a shut-off valve 110, 112 and a respective faucet handle 114, 116. In operation, the valve assembly 106, 108 is controlled by either coordinated signals or dual foot-operated sending units 52, 80 and 90 to regulate flow in either or both of the supply lines. It should be noted however that this embodiment of the invention will control both water temperature and pressure. If a single sending unit is employed, preferably distinct channel signals are transmitted to each receiving unit.

It should thus be seen that there is provided a remote controlled faucet which achieves the various objects of this invention and which is well adapted to meet conditions of practical use.

Since various possible embodiments might be made of the present invention or modifications that might be made to the exemplary embodiments above set forth, it is to be understood that all materials shown and described in the accompanying drawings are to be interpreted as illustrative and not in a limiting sense.

Having thus described the invention there is claimed as new and desired to be secured by Letters Patent:

1. A remote controlled faucet having a nozzle defining a water discharge flow path, valve assembly means adapted for attachment to the nozzle within the flow path, said valve assembly means including a valve member and drive means for selectively displacing the valve member into the flow path, sending means located distant from the valve assembly for transmitting wireless radio control signals, said valve assembly including receiving means in communication with the sending means, said drive means being actuatable in response to said signals, said sending means including a foot pedal hingedly mounted to a base member having a sloped surface, the foot pedal being resiliently urged away from the sloped surface and yieldably displaceable toward the surface for completing a circuit to actuate the sending means.

2. A remote controlled faucet as claimed in claim 1 wherein the receiving means is adapted to generate command signals to the drive means.

3. A remote controlled faucet as claimed in claim 2 wherein the drive means includes a motor.

4. A remote controlled faucet as claimed in claim 3 wherein the valve assembly defines a passageway for confining the discharge flow path.

5. A remote controlled faucet as claimed in claim 4 wherein the valve member is slidably mounted for rectilinear displacement into the passageway.

6. A remote controlled faucet as claimed in claim 4 wherein the receiving means is selectively deactivatable for optional manual operation of the faucet.

7. A remote controlled faucet as claimed in claim 4 wherein the sending means is adapted for foot operation.

8. A remote controlled faucet as claimed in claim 7 wherein the sending means is actuatable by at least one of foot pressure and foot position.

9. A remote controlled faucet as claimed in claim 7 wherein the sending means is adapted for transmitting multiple control signals to the receiving unit.

10. A remote controlled faucet as claimed in claim 1 further including coupling means for securing the valve assembly to the faucet nozzle for retrofit installation.

11. A remote controlled faucet having a nozzle defining a water discharge flow path, valve assembly means adapted for selective attachment to the nozzle, said valve assembly means defining a longitudinal passageway for providing a continuous flow path from the nozzle to a discharge opening, said valve assembly means further including a valve member, drive means for engaging the valve member and selectively displacing the valve member into said passageway for intercepting the flow path, said drive means being activated by a remote sending unit, said sending unit being foot actuable for transmitting a radio signal, a receiving unit in communication with the sending unit, said receiving unit being adapted for transmitting command signals to actuate the drive means, the valve assembly means further including switch means, said switch means being adapted for deactivating the drive means and for retaining the valve member without the passageway to provide optional manual operation of the faucet.

12. A remote controlled faucet as claimed in claim 1 wherein the sending unit is positionable within an operating distance of approximately five feet from the receiving unit for radio communication without external antennas.

13. A remote controlled faucet as claimed in claim 1 wherein the sending unit is operable by the application of foot pressure, said use of foot pressure being adapted for completing a circuit to actuate the sending unit.

14. A remote controlled faucet as claimed in claim 13 wherein the sending unit includes a foot pedal hingedly mounted to a base member, said base member having an inclined surface, said foot pedal being resiliently urged away from said inclined surface and being yieldably displaceable toward the inclined surface for completing a circuit for actuating the sending unit.

15. A remote controlled faucet as claimed in claim 11 wherein the drive means includes a pinion gear, said valve member includes a gear rack wherein said pinion gear engages the gear rack for displacing the valve member.

16. A remote controlled faucet as claimed in claim 15 wherein the valve member is rectilinearly displaceable for coaction with a recessed portion of the passageway to provide sealing engagement.

17. A remote controlled faucet as claimed in claim 11 further including a coupler member, said coupler member being threaded at opposite ends, one end of said coupler member being adapted for threadable engagement with the nozzle and an opposite end of said coupler being engageable with the valve assembly means.

* * * * *